US005845985A

United States Patent [19]

Xiong et al.

[11] Patent Number: 5,845,985

[45] Date of Patent: Dec. 8, 1998

[54] NIGHT WRITER

[76] Inventors: Toungia Tei Xiong; Koua Xiong, both of 17621 Winston Dr., Country Club Hills, Ill. 60478

[21] Appl. No.: 815,212

[22] Filed: Mar. 12, 1997

[51] Int. Cl.[6] ..... B43K 29/10; F21V 33/00; F21K 27/00

[52] U.S. Cl. ..... 362/118; 362/109; 362/259

[58] Field of Search ..... 362/118, 259, 362/119, 120, 109

[56] References Cited

U.S. PATENT DOCUMENTS

| | | | |
|---|---|---|---|
| 1,304,131 | 5/1919 | Welton | 362/118 |
| 1,450,991 | 4/1923 | Stecher | 362/118 |
| 4,737,894 | 4/1988 | Kuch et al. | 362/118 |
| 4,964,024 | 10/1990 | Tsay | 362/118 |
| 5,388,038 | 2/1995 | Yang | 362/118 |
| 5,448,459 | 9/1995 | Rogers | 362/118 |
| 5,470,164 | 11/1995 | Chen | 362/118 |
| 5,523,928 | 6/1996 | Kim | 362/118 |
| 5,673,996 | 10/1997 | Ducker | 362/118 |

FOREIGN PATENT DOCUMENTS

| | | | |
|---|---|---|---|
| 674823 | 7/1990 | Switzerland | 362/118 |
| 8605746 | 10/1986 | WIPO | 362/118 |

*Primary Examiner*—Sandra O'Shea
*Assistant Examiner*—Matthew J. Spark
*Attorney, Agent, or Firm*—Patent & Trademark Services; Thomas Zack; Joseph H. McGlynn

[57] ABSTRACT

A ball point pen having a pocket clip with a light source located within the clip. A self contained battery power source located in the pen's body is electrically connected to the light source through a button switch. Activation or deactivation of the button switch and its circuit for the light source is accomplished by depressing a rear mounted external button on the pen.

4 Claims, 1 Drawing Sheet

NIGHT WRITER

BACKGROUND OF THE INVENTION

Using a pen when there is little or no light available has proven to be a frustrating task. One may either find an external light source or combine a source with the pen to permit viewing the surface that is being written upon. The present invention relates to this common problem and combines pen and light source wherein the light source is located in the pen's pocket clip as further described herein.

DESCRIPTION OF THE PRIOR ART

Providing an artificial light source for a pen user has been addressed in the prior art. For example, in U.S. Pat. No. 4,737,894 to Kuch et al. a ball point pen has a light bulb located near the pen's point.

In U.S. Pat. No. 4,964,024 to Tsay the pen's light source is located in the lower portion of the pen.

The invention to Yang (U.S. Pat. No. 5,388,038) discloses a pen with a concave lens between the light and the pen point. In U.S. Pat. No. 5,523,928 to Kim the pen has an LED unit having a carrier of light transmitting material. The present invention differs from this and the known prior art by providing for a pen having pocket clip with a light in the clip itself as more further set forth in this specification.

SUMMARY OF THE INVENTION

This invention relates to a pen having a pocket clip with a light source located within the clip. A self contained power source located in the pen's body is electrically connected to the light source. Activation of the light source is accomplished by depressing a switch mounted on the pen.

It is the primary object of the present invention to provide for an improved pen and light source.

Another object is to provide for such an apparatus wherein the light source is located in the pen's pocket clip.

These and other objects and advantages of the present invention will become apparent to readers from a consideration of the ensuing description and the accompanying drawings.

DESCRIPTION OF THE PREFERRED EMBODIMENT

Figure 1:
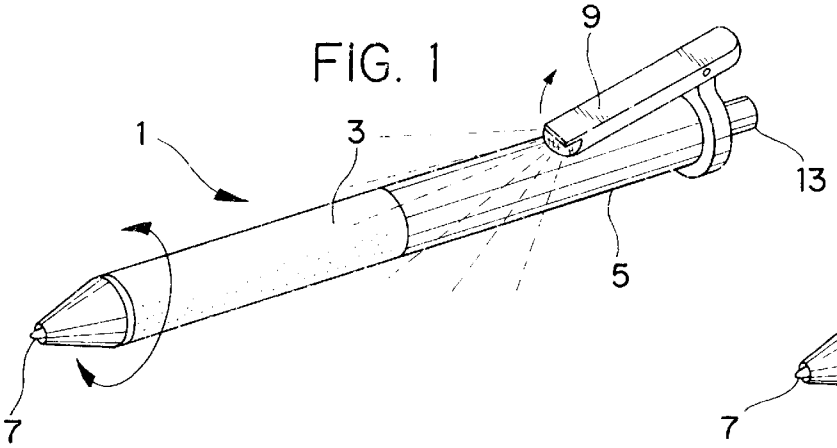
FIG. 1 is a side perspective view of the invention's preferred embodiment.

FIG. 1 is a side perspective view of the invention's preferred embodiment. The ball point pen 1 has two cylindrical body sections, a front body section 3 and an adjacent rear body section 5. The front section 3 can be twisted, as shown by the directions of the arrows, to deploy or retract the pen's front writing ball point 7. Located towards on the pen and attached to the rear of body section 5 is the pocket clip 9. This clip may be used to hold the pen to the pocket of a user. The clip houses a mini-flashlight light source 11 whose emitted light beam is directed to the pen's front to illuminate a writing surface (not shown) on which the ball point 7 engages. Located at the rear most part of the pen is the push button release 13. When this push button is depressed by a user an internal pen mechanism switches power on such that a self contained power source (or battery) supplies electrical power to the light source 11. Once, power is supplied, depressing the button 13 again will disconnect the light source from its internal battery power source.

Figure 2:
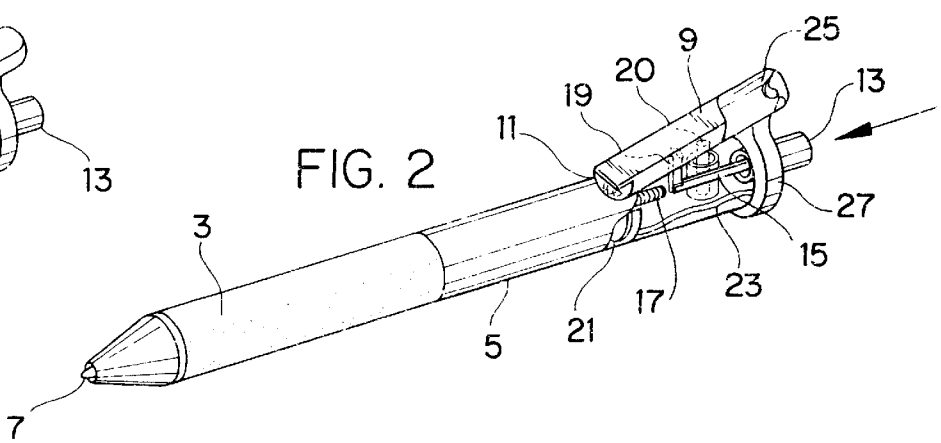
FIG. 2 is a similar side perspective view as in FIG. 1 with a part of the rear section of the pen's body and clip cut away to reveal its internal workings.

FIG. 2 is a similar side perspective view as in FIG. 1 with part of the pen's rear section 5 and clip cut away to reveal its internal workings. Aligned and connected to push button 13 is an L-shaped elongated member 15 having two legs one of which is aligned with button 13 and the other perpendicular to it. Depressing button 13 causes the connected elongated member 15 to move forward which releases the tension on the top spring loaded hinge 17. When this happens, the L-shaped member's vertical leg 19, located approximately perpendicular to the longitudinal axis of its other leg and push button 13, is pressed against the underside of the clip's rear causing the clip's front end to tilt up depressing the internal button style power switch 20 and completing an electric circuit to the button type battery 21. Appropriate internal conductive connecting elements 23 of the pen's rear section 5 are electrically connected to the battery, button switch 20 and light source 11 to complete the electric circuit when the external rear button 13 is depressed. The spring clip 25 used to retain the pocket clip 9 and its mounted rear ring mount 27 is also shown. By requiring sufficient movement of the power switch 20 to activate the circuit, simply inserting the pen and its pocket clip into the pocket of a user will not activate the light source although the clip may be slightly tilted upwardly in this action. Once the light source circuit is activated, depressing button 13 again will result in the internal button switch being depressed and cutting off power from the battery to the light source. Thus, alternate pressing of the button switch 20 will alternate in completing and disconnecting power, or vice versa, to the light source 11.

Figure 3:
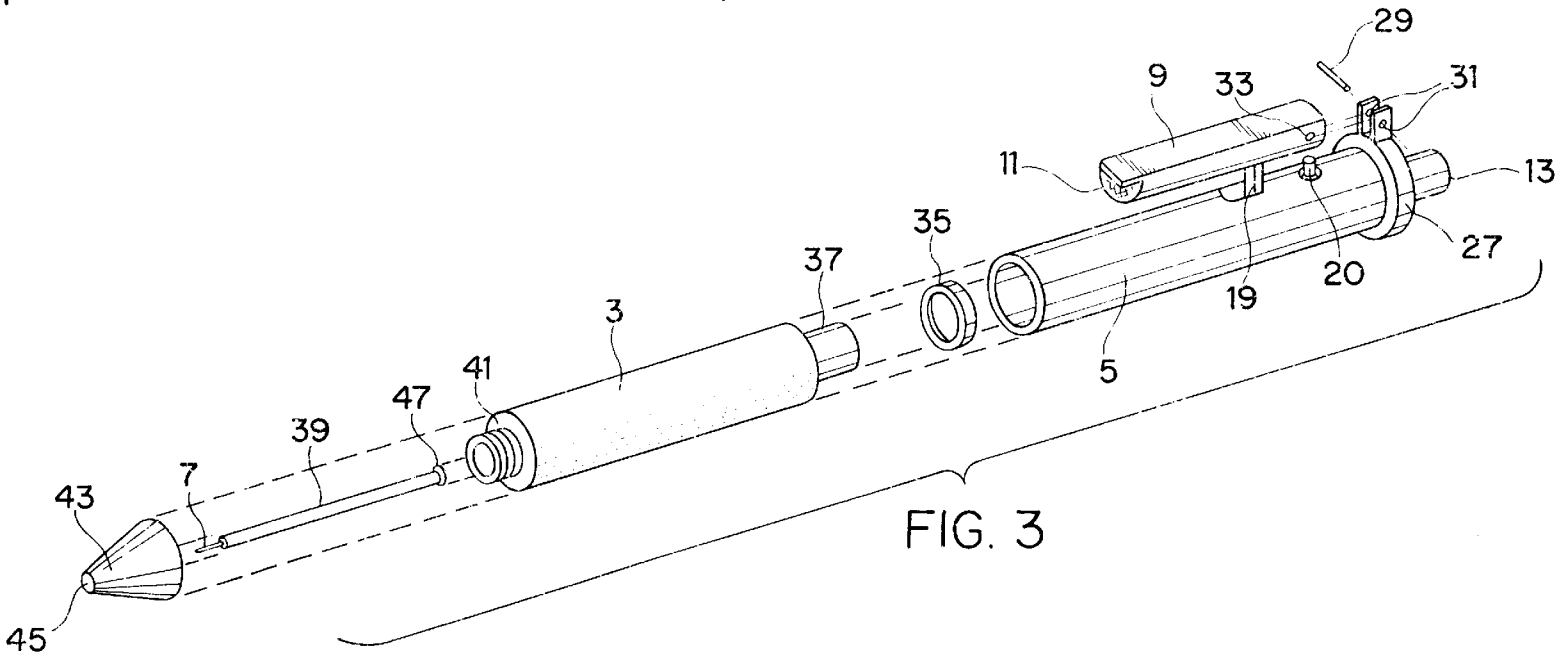
FIG. 3 is an exploded perspective side view of the pen's front internal components.

FIG. 3 is an exploded perspective side view showing the pen's front internal components. Starting at the pen's rear the ring mount 27 is shown pivotally connected to the pocket clip 9 by a pin 29 extending through two holes 31 in the mount and a hole 33 in the clip's rear. This pin mount permits the clip to tilt and activate the power switch 20 whose upper contacting end is shown as well as the vertical leg 19 of the L-shaped member 15. At the interface between the pen's two body sections 3 and 5, a ring spacer/washer 35 is shown. A protruding hollow member 37 fixed to front body section 3 has an outer diameter such that it can snugly fit through ring 35 and into the opened end of section 5. This snug fit holds the ring in place and the two body sections together. The conventional refillable ink barrel cartridge 39 with its integral ink dispensing front end writing point 7 fits into the hollow of section 3 and may be inserted or replaced by pulling the two pen body sections apart. Protruding external threads 41 on the end of body section 3 screw into internal threads (not shown) in the cone shaped pen nosepiece 43 to retain it to the body. A hole 45 through piece 43 permits the inplace cartridge end 7 to extend therefrom. Twisting the body section 3 causes internal threads in the body to engage the in place cartridge's enlarged rear end 47 to move the cartridge back and forth along the pen's section to either extend or retract the cartridge's front writing point 7.

The two body sections of the pen, the clip 9 and the ring mount 27 can all be manufactured using the plastic injection molding process. Injection molding is a plastic molding process whereby heat softened plastic material is forced under very high pressure into a metal cavity mold, usually aluminum or steel, which is relatively cool. The inside cavity of the mold is comprised of two or more halves, and is the same desired shape as the product to be formed (in this case the body, clip and mount). High pressure hydraulics are used to keep the mold components together during the actual injection phase of the molding process. The injected plastic is allowed to cool and harden in the mold. The hydraulics holding the multiple component mold cavity together are released, the mold halves are separated and the solid formed plastic item is removed. Injection molding can be highly automated process and is capable of producing extremely detailed parts at a very cost effective price. The process should be invaluable in producing this invention's plastic components cost effectively.

The metal components of the preferred embodiment such as the L-shaped member 15, the ring 35, the front nose piece 45, pin 29 can all be manufactured using the metal stamping process. Metal stamping is a process whereby flat metal is formed between two parts of a die under tremendous pressure. The metal can be punched, formed and shaped in these dies, many times in one process, and spot welding of separate components can be employed to complete the assembly of sheet metal components. The stamped metal may be stainless steel or plated carbon steel to prevent rusting.

The light bulb used in the mini-flashlight source 11 is available as an "off the shelf" component and is known as a grain of wheat bulb. A high intensity Light Emitting Diode (LED) could be substituted for this grain of wheat bulb if desired. The button battery 20 is also available for purchase as an off the shelf component. The Thomas Register of American Manufacturers is a good source for locating suppliers for these and other off the self components.

Although the present invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What we claim as our invention is:

1. A writing implement having an attached pocket clip with a light source comprising:

a writing implement having a hollow body with a front portion, a front writing element capable of deploying or retracting in the front portion of said body and a rear portion opposite said front portion, said hollow body also having a rear body mounted external pocket clip adapted to fasten the writing implement to a clothing pocket of a user;

a push button switch mounted in the rear portion of said hollow body and extending therefrom:

a self-contained electrical power source mounted within the hollow body and electrically connectable to said push button switch; and a mini-light source mounted in said external pocket clip and electrically connectable to said power source in the hollow body by pushing on said push button switch, said light source being capable of emitting a light towards the front writing element when connected to said power source.

2. The invention as claimed in claim 1, wherein said writing element is a ball point pen.

3. The invention as claimed in claim 2, wherein said mini-light source has a light emitting diode.

4. The invention as claimed in claim 2, wherein said pen has front and rear sections and said writing element is a refillable ink cartridge with a front writing tip mounted in said front body section, said writing tip being capable of moving to an exposed position with respect to the front body section by twisting the front body section of the pen.

* * * * *